United States Patent [19]

Kohl

[11] 4,449,381

[45] May 22, 1984

[54] WARP KNITTING MACHINE WITH JACQUARD ATTACHMENT

[75] Inventor: Karl Kohl, Obertshausen, Fed. Rep. of Germany

[73] Assignees: Morton Jablin, Tenafly; Johann Winter, Paramus, both of N.J. ; part interest to each

[21] Appl. No.: 349,625

[22] Filed: Feb. 17, 1982

[30] Foreign Application Priority Data

Aug. 1, 1981 [DE] Fed. Rep. of Germany ..... 3130555

[51] Int. Cl.[3] ..... D04B 23/00

[52] U.S. Cl. ..... 66/203; 66/207; 66/214

[58] Field of Search ..... 66/203, 204, 207, 214

[56] References Cited

U.S. PATENT DOCUMENTS

| | | | |
|---|---|---|---|
| 3,952,549 | 4/1976 | Kohl | 66/207 |
| 4,137,734 | 2/1979 | Kohl | 66/214 |
| 4,240,275 | 12/1980 | Fiedler | 66/203 |

*Primary Examiner*—Ronald Feldbaum

*Attorney, Agent, or Firm*—Stephen E. Feldman

[57] ABSTRACT

A warp knitting machine with Jacquard attachment including two knitting needles situated side-by-side, to which there are allocated two eye-pointed needles and only one urging feeder pin. Typically, the eye-pointed needles allocated to, respectively, two knitting needles can be displaced jointly by the urging feeder pin allocated to the two eye-pointed needles.

6 Claims, 6 Drawing Figures

WARP KNITTING MACHINE WITH JACQUARD ATTACHMENT

BACKGROUND OF THE INVENTION

1. Field of the Invention

A warp knitting machine with Jacquard attachment.

2. Description of the Prior Art

On a warp knitting machine with Jacquard attachment, the urging feeder pins which are spring-biased and are movable in a longitudinal guide must, in order to bring about a lateral displacement of the eye-pointed needles, so as to produce the desired pattern, be endowed with a certain sturdiness capable of causing a brief lateral deflection of the free end of the spring-biased eye-pointed needles; therefore one cannot go below a minimum strength of material of the urging feeder pins. It has therefore hitherto been necessary to make do with Jacquard attachments having a coarse needle spacing situated at about 36 RE. Moreover, as a result of the comparatively substantial difference in the yarn consumption, between the pattern threads and the ground threads, the coarse needle spacing makes it indispensable to arrange bulky bobbin creels for the supplying of the yarn.

SUMMARY OF THE INVENTION

Purposes of the Invention

It is an object of the present invention to provide an improved warp knitting machine.

Another object is to provide an improved warp knitting machine with Jacquard attachment.

A further object is to provide a warp knitting machine with Jacquard attachment comprising two knitting needles situated side-by-side, to which there are allocated two eye-pointed needles and only one urging feeder pin.

An additional object is to provide a warp knitting machine with Jacquard attachment in which the eye-pointed needles allocated to, respectively, two knitting needles, can be displaced jointly by the urging feeder pin allocated to the two eye-pointed needles.

These and other objects and advantages of the present invention will become evident from the description which follows.

BRIEF DESCRIPTION OF THE INVENTION

In accordance with the present invention, it has now become possible to increase the needle bed gauge up to 48 and 56 RE, without reducing the sturdiness of the urging feeder pins. According to the invention, it is provided that, in each case, to two juxtapositioned knitting needles there are allocated two eye-pointed needles, and only one urging feeder pin. Accordingly, it has become possible to serve two eye-pointed needles with one urging feeder pin, thereby leaving sufficient room for a sturdy urging feeder pin. It is true that this imposes some restricting of the patterning; this is however of no consequence in practice; the knitted goods also impart the appearance of greater density.

In particular, according to the invention there is provided a control of the urging feeder pins, so that the urging feeder pin that is allocated to, respectively, two juxtapositioned needles, engages alternatingly the one and the other of the needles. The resultant advantage is that the path travelled by the urging feeder pin bar, for the actuating of two eye-pointed needles, brings about a reduction in the yarn consumption between the pattern and the ground yarn, and that the yarn can now be supplied from the yarn beam.

According to another mode of realization of the invention, it is provided that the eye-pointed needles allocated to, respectively, two needles, can be jointly displaced or pushed back by the urging feeder pin allocated to the two needles. In that arrangement, the two related eye-pointed needles can be firmly interconnected and be series-connected in the direction of swing, as well as staggered by a needle in racking direction, or else the two eye-pointed needles are positively interconnected during the displacement. The novel attachment can also be installed, without any special arrangements, on an existing machine provided with a Jacquard attachment. Finally, in spite of the fine needle gauge, the novel attachment does not require an additional Jacquard head.

In summary, the present invention contemplates a warp knitting machine with Jacquard attachment, characterized in that to, respectively, two knitting needles situated side-by-side, there are allocated two eye-pointed needles and only one urging feeder pin. Typically, the urging feeder pin bar is controlled in such a way that the urging feeder pin allocated, respectively, to two eye-pointed needles arranged side-by-side, engages alternatingly the one and the other needle interspace. In a preferred embodiment, the eye-pointed needles allocated to, respectively, two knitting needles can be displaced jointly by the urging feeder pin allocated to the two eye-pointed needles. In this preferred embodiment, typically the two eye-pointed needles allocated to, respectively, two knitting needles are fixedly interconnected, and are situated one behind the other in the direction of swing, and are also staggered by one needle spacing in the direction of racking. Also in this preferred embodiment, typically the two eye-pointed needles, allocated in each case to two knitting needles, are positively interconnected during the displacement. In this case, preferably a stop is arranged to at least one of the eye-pointed needles, the stop being oriented toward the adjoining one.

The invention accordingly consists in the features of construction, combination of elements, and arrangement of parts which will be exemplified in the machine device hereinafter described, and of which the scope of application is as elucidated supra and as will be indicated in the appended claims.

BRIEF DESCRIPTION OF THE DRAWINGS

In the accompanying drawings, in which exemplified embodiments of the invention are illustrated.

DETAILED DESCRIPTION OF THE PREFERRED EMBODIMENTS

Figure 1:
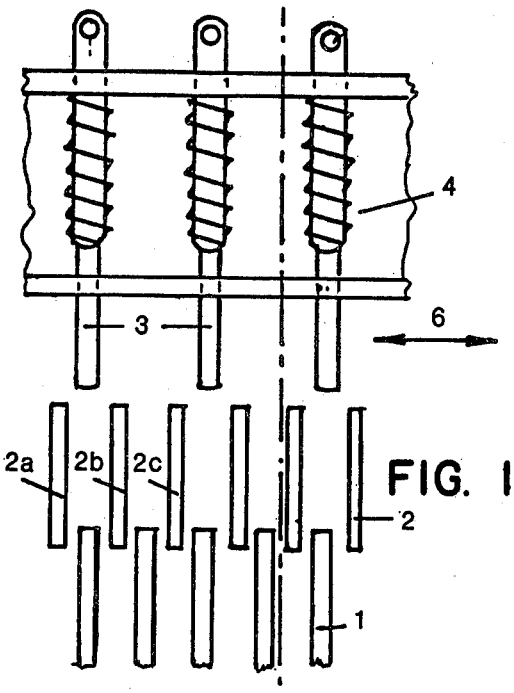
FIG. 1 shows, as a partial view, an arrangement in which one urging feeder pin is allocated to two eye-pointed needles, which displaces alternatingly the one and the other eye-pointed needle.
Figure 2:
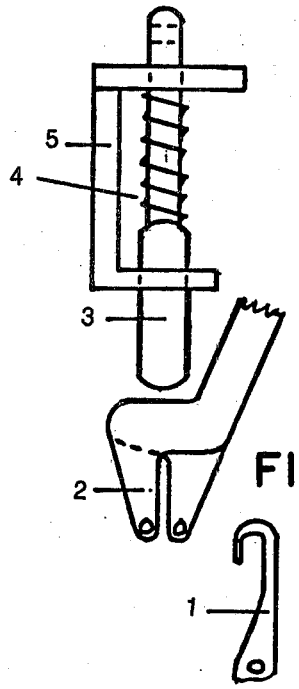
FIG. 2 is a cross-section through the attachment of FIG. 1 along line II—II.

In the mode of realization illustrated in FIGS. 1 and 2, one can note the knitting needles 1, the eye-pointed needles 2 and the urging feeder pins 3 of the Jacquard attachment 4, of which the drawing illustrates only the lower portion. The urging feeder pin 5 is controlled in racking direction (direction of the arrow 6), in such a way that the urging feeder pins 3 enter, on the one hand, between the eye-pointed needles 2*a* and 2*b* and, on the other, between the eye-pointed needles 2*b* and 2*c*. From the cross-section representation of FIG. 2 one can note that, as a result of this novel arrangement, a sturdy urging feeder pin 3 is provided with sufficient room between the two eye-pointed needles 2, even if one chooses an extremely fine needle bed gauge.

Figure 3:
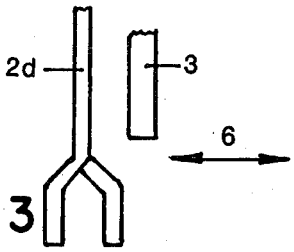
FIGS. 3 and 4 respectively represent an elevation and a side view of an attachment in which two juxtapositioned eye-pointed needles are firmly interconnected.
Figure 4:
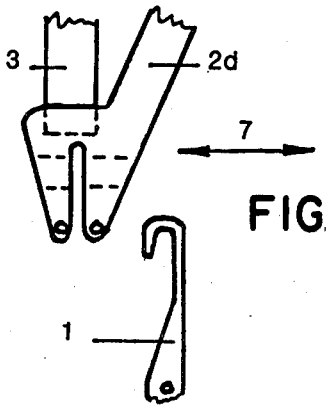

In the case of the example illustrated in FIGS. 3 and 4, two eye-pointed needles situated side-by-side are firmly interconnected to one needle 2*d*, and are situated one behind the other in the direction of swing 7, and are staggered by one needle spacing in racking direction 6.

Figure 5:
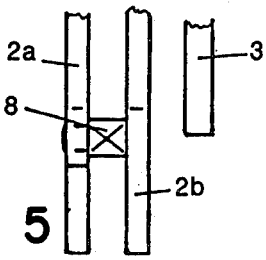
FIGS. 5 and 6 respectively show an elevation and a side view of an attachment in which in each case two eye-pointed needles arranged side by side are positively interconnected during their displacement.
Figure 6:
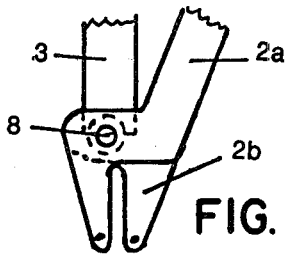

In the case of the example of FIGS. 5 and 6, two eye-pointed needles 2*a* and 2*b* arranged side-by-side are positively interconnected during the displacement by the urging feeder pin 3 in that at the one needle 2*b* there is arranged a stop 8 oriented toward the other.

It will thus be seen that there is provided a warp knitting machine with Jacquard attachment which achieves the various objects of the invention and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above is presented merely as an example of the invention. Other embodiments, forms and modifications of the invention, coming within the proper scope and spirit of the appended claims, will of course readily suggest themselves to those skilled in the art. Thus, while there has been described what is at present considered to be the preferred embodiment of the invention, it will be obvious to those skilled in the art that various changes and modifications may be made therein, without departing from the invention, and it is, therefore, aimed in the appended claims to cover all such changes and modifications as fall within the true spirit and scope of the invention.

What is claimed is:

1. A warp knitting machine with Jacquard attachment; comprising:

(a) a plurality of knitting needles arranged in spaced and side by side relationship;

(b) a plurality of eye-pointed needles arranged in spaced and side by side relationship and disposed for coaction with said knitting needles;

(c) each successive adjacent pair of said eye-pointed needles including a first eye-pointed needle and a second eye-pointed needle;

(d) a plurality of urging feeder pins arranged in spaced and side by side relationship and disposed for coaction with said eye-pointed needles;

(e) their being only a single urging feeder pin for each said pair of eye-pointed needles.

2. The warp knitting machine with Jacquard attachment of claim 1 wherein urging feeder pin control means are provided for said plurality of urging feeder pin so as to move same either so that each of said urging feeder pins move into and out of a first space located between said first and said second eye-pointed needles of each of said pairs of eye-pointed needles; or a second space located between said second eye-pointed needle of one of said pairs of eye-pointed needles and said first eye-pointed needle of the next successive pair of eye-pointed needles.

3. The warp knitting machine with Jacquard attachment of claim 1 wherein each pair of eye-pointed needles is displaceable jointly by the associated coacting urging feeder pin.

4. The warp knitting machine with Jacquard attachment of claim 3 wherein said first eye-pointed needle and said second eye-pointed needle of each of said pairs of eye-pointed needles are fixedly interconnected and are situated one behind the other in a first predetermined direction of swing, and are staggered by one needle spacing in a second predetermined direction of racking.

5. The warp knitting machine with Jacquard attachment of claim 3 wherein said first eye-pointed needle and said secured eye-pointed needle of each of said pairs of eye-pointed needles are positively interconnected for displacement in a predetermined manner.

6. The warp knitting machine with Jacquard attachment of claim 5 wherein one of said eye-pointed needles of each of said pairs of eye-pointed needles includes a stop oriented towards and disposed for coaction with the other of said eye-pointed needles of each of said pairs of eye-pointed needles.

* * * * *